United States Patent [19]

Sierra

[11] Patent Number: 4,590,777

[45] Date of Patent: May 27, 1986

[54] DOORLOCK

[76] Inventor: Rafael Sierra, 639 Alamitos Ave., Long Beach, Calif. 90802

[21] Appl. No.: 543,690

[22] Filed: Oct. 20, 1983

[51] Int. Cl.[4] ..... E05B 63/12

[52] U.S. Cl. ..... 70/104; 70/134; 70/150; 70/448; 70/467; 70/484; 70/488; 70/489; 70/DIG. 20

[58] Field of Search ..... 70/104, 124, 129, 134, 70/150, 151, 155, 448, DIG. 20, 467, 468, 481–489, 471

[56] References Cited

U.S. PATENT DOCUMENTS

| | | | |
|---|---|---|---|
| 1,554,839 | 9/1925 | Brown | 70/150 |
| 1,580,611 | 4/1926 | Kirkpatrick | 70/448 X |
| 1,855,089 | 4/1932 | Boothe | 70/483 X |
| 2,136,584 | 11/1938 | Benjamin | 70/150 |
| 2,638,771 | 5/1953 | Comey et al. | 70/448 X |
| 3,811,302 | 5/1974 | Sorensen | 70/129 X |
| 4,363,227 | 12/1982 | Lo | 70/151 R X |

FOREIGN PATENT DOCUMENTS

| | | | |
|---|---|---|---|
| 128434 | 10/1946 | Australia | 70/129 |

*Primary Examiner*—Kenneth J. Dorner
*Assistant Examiner*—Lloyd A. Gall
*Attorney, Agent, or Firm*—Grover A. Frater

[57] ABSTRACT

A key operated doorlock, which may incorporate a deadbolt, has a bolt housing that is mounted on the exterior of the door and is held there by being fastened to a spacer disposed within the door and a mounting plate at the interior side of the door. The main bolt is locked in place with a secondary locking apparatus which may include a barrel lock which operates a bolt which cooperates with a keeper opening in still another bolt. The latter engages a keeper opening that forms part of the housing. A lever system is provided which permits operation of the third bolt when permitted by the state of the second mentioned bolt.

18 Claims, 18 Drawing Figures

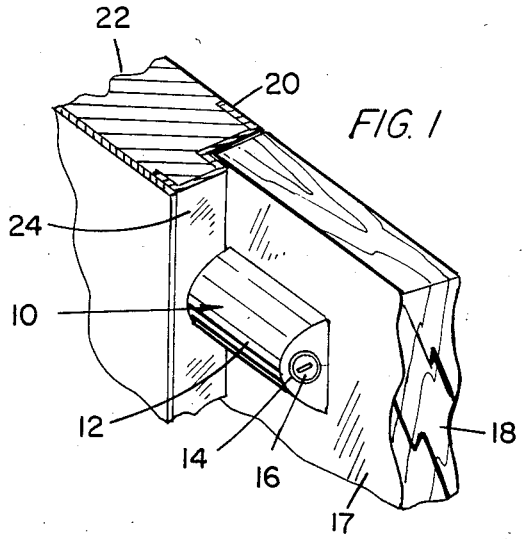
FIG. 1
FIG. 2
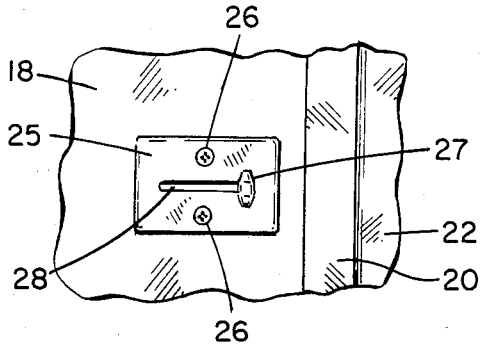
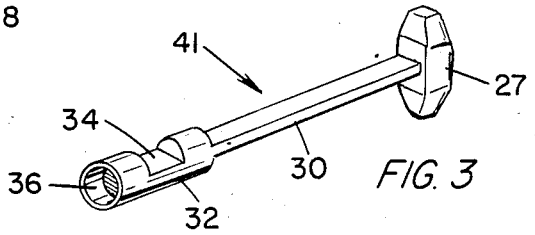
FIG. 3
FIG. 6
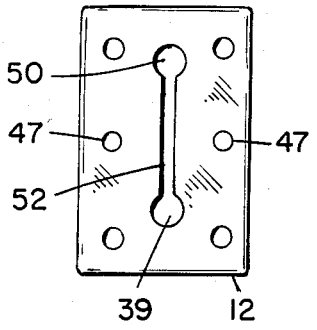
FIG. 7
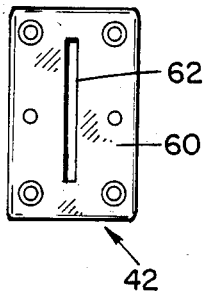
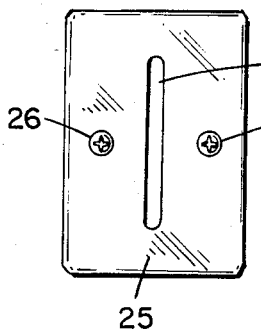
FIG. 8
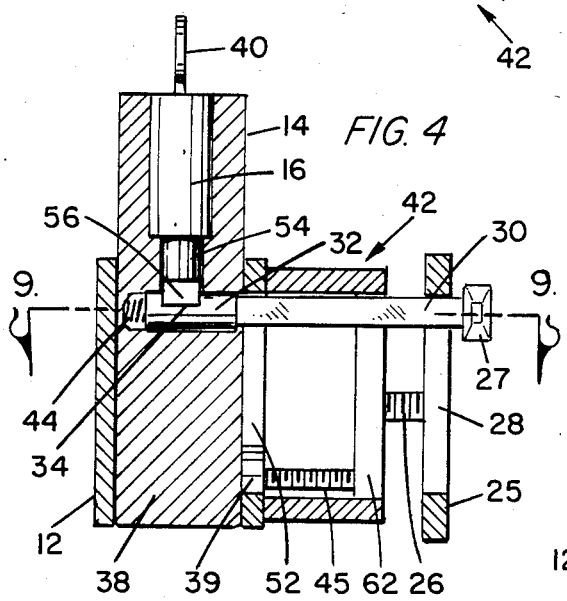
FIG. 4
FIG. 5
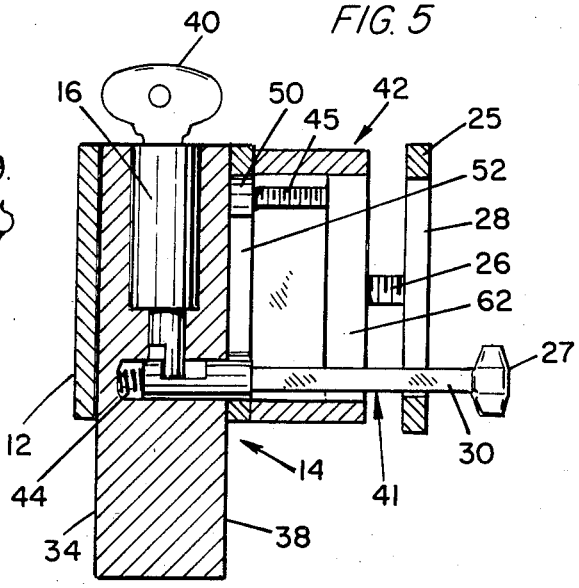

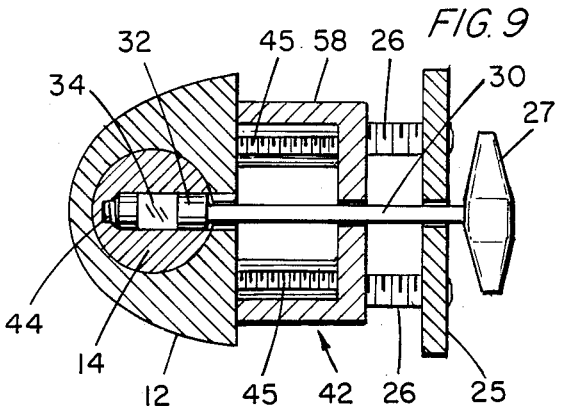
FIG. 9
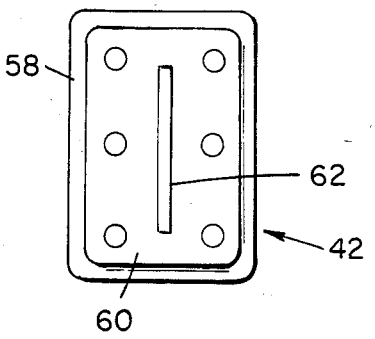
FIG. 10
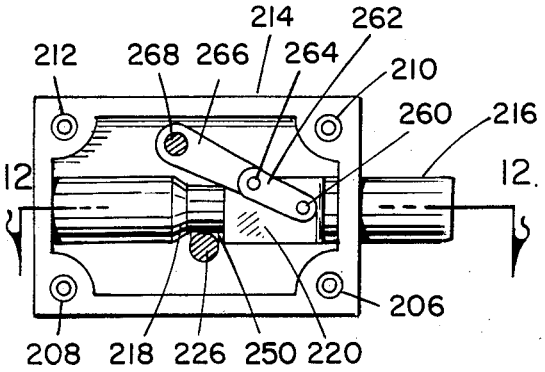
FIG. 11
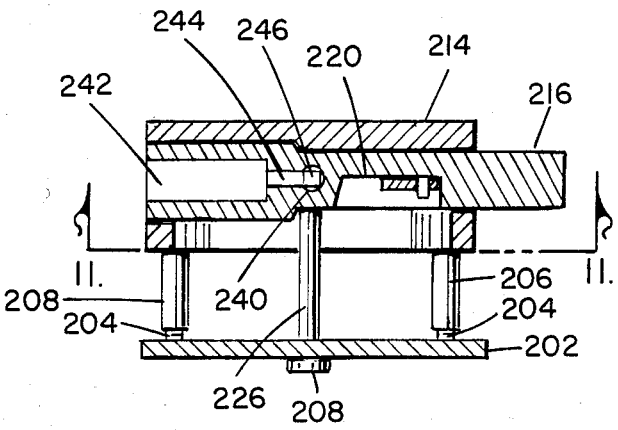
FIG. 12
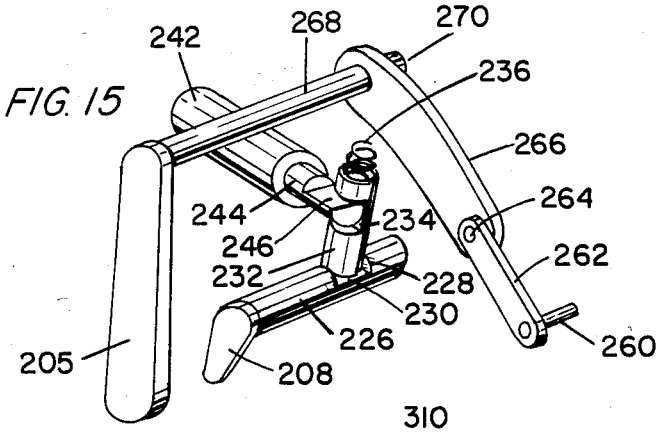
FIG. 15
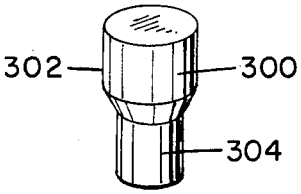
FIG. 17
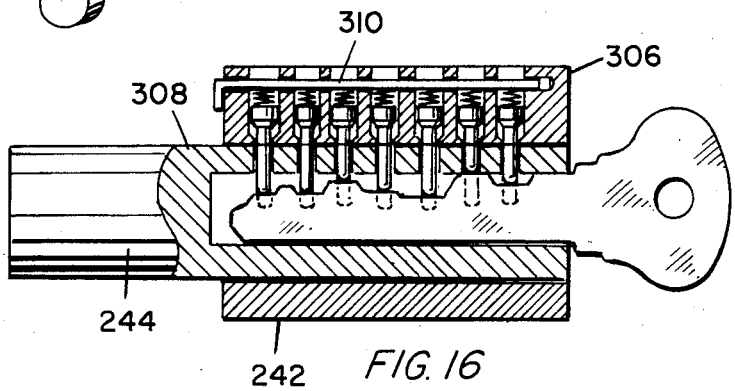
FIG. 16
FIG. 18
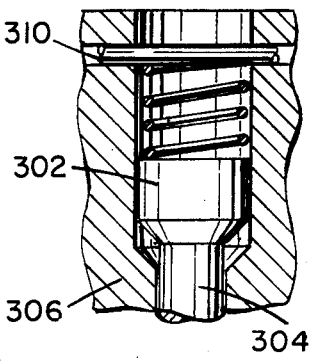

DOORLOCK

TECHNICAL FIELD

This invention relates to improvements in doorlocks.

BACKGROUND ART

The ingenuity of those who would violate a lock has led to the development of a wide variety of locking structures. Most of them are designed to provide security in a particular environment or circumstance. One of those circumstances is the locking of doors, and particularly exterior doors.

Several philosophies concerning the design of doorlocks currently prevail. One approach is to create a lock whose mechanism and size and apparent strength are hidden from view. The reasoning behind that approach is that the intruder will be discouraged because of his inability to assess what degree of difficulty will be involved in violating the lock.

An opposite approach is to employ a strong locking structure whose shape or other attributes make it difficult to apply force with which to violate the lock. The object of that philosophy is to make it apparent that violation will be a difficult task and, thus, to discourage any attempt to defeat the lock.

DISCLOSURE OF INVENTION

It is an object of this invention to provide an improved doorlock. Another object is to provide a deadbolt-style doorlock whose exterior is visible to those who might attempt to defeat it, and which can be produced in a form which makes the application of breaking force very difficult wherefor to discourage attempts to defeat it.

Another object is to provide a strong, hard to violate locking structure which can be produced with minimal cost and which employs either a key or a combination actuated mechanism. A further object is to provide a lock which can employ a simple barrel locking mechanism arranged so that the structure will fail in locked condition if the barrel is removed. A still further object is to provide an improved piston pin structure for lift pin locks.

These and other objects and advantages of the invention which will appear upon an examination of the accompanying drawings and a reading of the specification that follows are realized, in part, by the provision of a deadbolt housing that is attached to the exterior of the door substantially flush against the jam. The bolt is latched to the bolt housing so that pounding on it to change its position on the door will not release the latch.

A novel lever system permits operation of the latching mechanism from the inside whether or not the exterior mechanism is locked.

A further object is to provide a lock structure which is readily produced in either key lock or combination lock form and which can be changed from one to the other and to employ different keys or combinations without the need for special tools.

BRIEF DESCRIPTION OF THE DRAWINGS

In the drawings:

FIG. 1 is an isometric view of a fragment of a door and a door jamb held locked by a lock that embodies the invention;

FIG. 2 is a view in elevation of the opposite side of the fragment shown in FIG. 1, showing the lever by which the lock is actuated from the interior;

FIG. 3 is an isometric view of the structure that serves as the inside operating latch and as the bolt of the internal lock;

FIG. 4 is a cross-sectional view taken on the horizontal midplane of the locking structure of FIGS. 1 and 2 shown in the unlocked condition;

FIG. 5 is a cross-sectional view taken on the same plane as is the view in FIG. 4 but showing the structure in locked condition with its primary bolt extended;

FIG. 6 is a view in elevation of the bolt housing shown from the side that faces the door when assembled;

FIG. 7 is an elevational view of the spacer element shown from the side away from the bolt housing;

FIG. 8 is a view in elevation of the inside door plate shown from the side away from the door and showing the heads of the two bolts by which the plate is secured to the bolt housing;

FIG. 9 is a cross-sectional view taken on line 9—9 of FIG. 4;

FIG. 10 is a view in elevation of the side of the spacer opposite that shown in FIG. 7;

FIG. 11 is a rear view of the main portion of a modified form of the preferred embodiment sectioned on line 11—11 of FIG. 12 shown in locked condition;

FIG. 12 is a cross-sectional view taken on line 12—12 of FIG. 11;

FIG. 15 is an isometric view of certain elements of the lock of FIG. 11;

FIG. 16 is a cross-sectional view of the barrel lock and key employed in the lock of FIG. 1;

FIG. 17 is an enlarged isometric view of a piston of the structure of FIG. 16; and FIG. 18 is an enlarged fragment of what is depicted in FIG. 16.

DESCRIPTION OF THE PREFERRED EMBODIMENT

Figure 13:
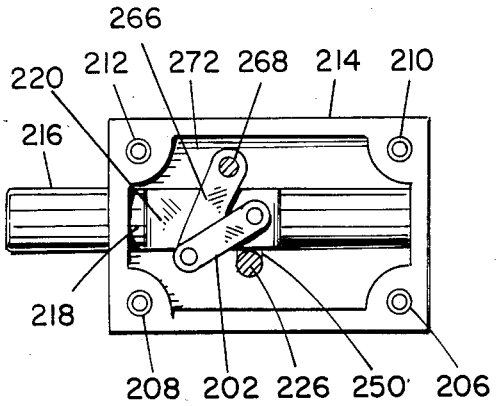
FIG. 13 is a view corresponding to that of FIG. 11 except that it is shown in unlocked condition.

The invention may be embodied in a variety of structural forms. The best mode for practicing the invention, and the currently preferred form, is illustrated in FIGS. 1 through 18 of the drawing.

In FIG. 1 the lock is generally designated 10. The portions that are visible include the bolt housing 12 and the bolt 14. The bolt includes a key operated locking mechanism 16 which, in this embodiment, has barrel form.

The lock 10 is shown to be mounted on the exterior side 17 of a door 18 which is closed and locked to a door jamb 20. In this case the jamb is a shaped metal rail which is mounted on the face of the framing member 22. The jamb is shaped to form an integral stop and, while not visible in FIG. 1, the lock 10 includes a deadbolt which extends into a keeper opening formed in the stop portion 24 of the jamb.

The opposite side of the door is shown in FIG. 2, again with the door 18 closed and locked. The interior side of the locking structure 10 includes a mounting plate 25 which is secured to the remainder of the lock structure by a pair of bolts 26. The handle 27 is part of a secondary actuator that is arranged for reciprocal motion along the elongated slot 28. The slot extends in a direction parallel to bolt movement, toward and away from the jamb 20.

The handle 27 is shown in FIG. 3 to be fixed to an elongated flat rod 30 that terminates in a cylindrical secondary bolt 32. The secondary bolt is notched halfway through at 34 by a notch whose side walls are parallel with one another and perpendicular to the bottom wall which lies in a plane parallel to the broad sides of the bar 30. The end of the secondary bolt 32 away from the handle 27 and bar 30 is recessed to form a cavity 36 in which a bias spring is lodged in the assembled lock structure.

The secondary actuator of FIG. 3 is visible in FIGS. 4, 5 and 9. In those figures it is shown related to the remainder of the lock structure. In FIGS. 4 and 9, the structure of FIG. 3 is shown in the position it occupies when the locking structure is unlocked and the bolt is fully retracted. In FIG. 5 the structure of FIG. 3 is shown in the position it occupies when the lock is in locked condition with the primary bolt 14 extended. In this condition, the secondary bolt 32 has been moved to the right in FIG. 5 into a keeper opening formed through the inside wall of the bolt housing 12. That keeper opening can be seen in FIG. 6 and in FIG. 4 where it is identified by the numeral 39.

The parts of the lock structure include the bolt housing 12, the bolt 14 the forward end 38 of which is the part that extends forward into the keeper opening in the door jamb 20, the barrel lock 16 with its key 40, the structure of FIG. 3 which, for convenience, is numbered 41 and is named the "secondary bolt and secondary actuator," the spacer block 42, the inner mounting plate 25, the bias spring 44 which may be seen in FIG. 4, 5 and 9 and whose purpose is to bias the structure 41 to the locked condition in which the inner bolt 32 is disposed in the opening 39, and four bolts numbered 45 which serve to hold the spacer block 42 in position against the inner face of the bolt housing 12, and, finally, the two machine screws 26 which extend through the inner mounting plate 25 and the spacer block 42 into threaded openings 47 in the bolt housing.

The shape of the bolt housing 12 may be understood from a comparison of FIGS. 1, 4, 5, 6 and 9. Its external shape is approximately that of a half of a right cylinder or, expressed another way, one portion of a right cylinder which has been divided into two halves by being cut on a plane containing the axis of the cylinder. The right cylinder half is bored from end to end to receive the cylindrical bolt structure. The flat face is bored at right angles through the wall of the housing to communicate with the longitudinal bore in which the bolt is lodged. One of the openings thus formed is the keeper hole 39, and the other is the keeper hole 50. Those openings are formed near the ends of the block substantially on its midline. The wall of the bolt housing at its flat side is milled through to the bolt opening to form a slot 52 that joins the two keeper openings 39 and 50. That is best seen in FIG. 6.

The barrel lock 16 is formed with a rotatable extension 54 which extends axially from the barrel at the side opposite the key opening. The extension is cylindrical except that a portion of its outer end at 56 is milled flat down through its longitudinal midplane. Its shape can be understood by comparing FIGS. 4 and 5, and knowing that the extension 54 has been rotated ninety degrees in FIG. 5 from the rotational position it is seen to have in FIG. 4.

A comparison of FIGS. 4, 5, 7, 9 and 10 show that the spacer block 42 is a rectangular block recessed deeply at one side to reduce the amount of material required in its construction. The wall away from the bolt housing is numbered 60, and its outer surface is shown in FIG. 7.

The side toward the bolt housing 12 is shown in FIG. 10 where the marginal wall around the element is numbered 58. Six holes are formed in the wall 60 to accommodate the six screws by which the unit is held together. There is a slot 62 milled through the wall 60 on the midline of the element. In the assembled condition, that slot extends in the same plane with slot 28 of the inner mounting plate 25 and with the slot 52 which is formed through the inner wall of the bolt housing 12.

The mounting plate 25 is shown in FIGS. 4, 5, 8 and 9 and comprises a flat plate formed with the elongated slot 28 to accommodate the bar or shank 30 of the combined structure 41. In addition, it is formed with two openings to receive the mounting bolts 26.

The bolt 14 comprises a cylinder bored axially at the end opposite the end 38 to form a recess smaller at its inner end than it is at its outer end to receive the barrel lock 16 and its cylindrical extension 54 including the notched portion 56. The bore has size to permit easy rotation of the extension 54 and to receive the barrel portion with a pressed fit. A set screw, not shown in the drawings, is employed to maintain the barrel 16 against rotation and axial displacement. A transverse bore is formed along the diameter of the bolt 14 from one side of the bolt to a point near its opposite surface. It has diameter to receive the inner bolt 32 with an easy sliding fit. The bottom of the opening is shaped to form a seat for the bias spring 44. That the bore is made on the diameter line of the bolt is best illustrated in FIG. 9. That the transverse bore is made at a point where it will intersect the bore in which the lock extension 54 is lodged is best shown in FIGS. 4 and 5.

The operation of the lock is explained as follows. The locked condition is illustrated in FIGS. 1, 2 and 5. The key 40 is shown in the lock to indicate that the barrel lock is turned to locked condition. In that condition, the extension 54 is rotated so that the face of the notch at the end of the cylindrical extension 54 is arranged vertically. The notch opens at the side away from the door, and in that circumstance the bias spring 44 has driven the structure 41 to the left in FIG. 5, toward the door, so that the left end of the bolt 32 is lodged in keeper opening 39 at the inner face of the bolt housing 12.

The diameter of the inner bolt 32 exceeds the width of slot 52 formed in the inner wall of the keeper housing 12. As a consequence, the inner bolt 32 prevents movement of the primary bolt 14 in either direction. End 38 of the primary bolt remains extended, and the door is locked as shown in FIGS. 1 and 2. FIG. 5 is a view from the bottom. The inner operating handle 27 and the rod 30 are positioned forwardly, and that is verified in FIG. 2. To open the lock, i.e. to retract end 38 of the bolt 14 from the inside, it is necessary to push the lever inwardly so that the inner bolt is moved inwardly against the bias of spring 44 out of the keeper opening 39 and entirely within the bolt 14. That is possible because the notch 34 is as long as the diameter of the barrel lock extension 54.

The handle 27 and the inner, secondary bolt 32 having been pushed inwardly, it is possible to push the lever rearwardly away from the jamb 20 in FIG. 2 so that the rod 30 is moved through the slot 28 in the mounting plate 25, and through the slot 62 in the spacer, and through the slot 52 in the inner wall of the bolt housing until the main bolt 14 is entirely retracted. The main bolt will then occupy the position it is shown to have in FIG. 4; however, unless the key 40 is turned to turn the cylindrical extension 54, the notch at end 56 will remain oriented as it is shown to be in FIG. 5. When the inner bolt 32 has been moved rearwardly into alignment with keeper opening 50, the bias spring 44 will force the inner bolt 32 into keeper 50. The handle 27 will be forced outwardly away from the mounting plate 25 and the primary bolt will be locked in the open position.

To permit movement of the primary bolt from the outer side of the door, either to extend the end 38 or to retract it, it is necessary to rotate the key 40 to the position it is shown to have in FIG. 4. When that is done, the cylindrical extension 54 and the notched portion 56 are rotated so that the entire diameter of the extension 54 must be accommodated within the notch 34 of the inner bolt 32. When that is done, inner bolt 32 is forced against the bias of spring 44 so that it lies entirely within the primary bolt 14. That having been done, the mechanism can be slid along through the bolt housing because the bar 30 will pass through the slots 52, 62 and 28.

Figure 14:
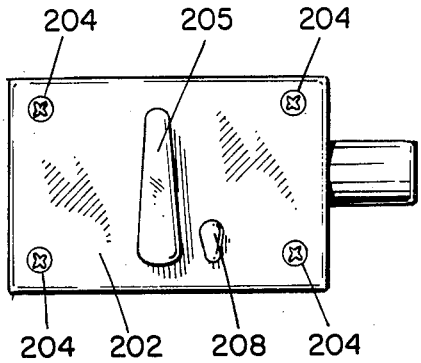
FIG. 14 is a view in rear elevation of the lock of FIG. 11.

A modification of the invention is depicted in FIGS. 11 through 15. The part of the bolt housing that is visible from the outside of the door when mounted looks just like the embodiment depicted in FIG. 1. FIG. 14 illustrates the portion of the lock that is visible from the interior side of the door, and that part includes the mounting plate 202 for mounting mounting bolts each numbered 204, the doorlock handle 205, and the latch lever 208. Some of those elements are visible in FIG. 12. As best shown in that figure, the mounting plate 202 is fastened to the remainder of the lock structure by bolts 204 which extend through the mounting plate and are threadedly engaged in internally threaded spacer posts. There are four of those posts. The two lower ones are shown in FIG. 12 where the one at the right is numbered 206 and the one at the left is numbered 208. Those posts are also visible in FIGS. 11 and 13 along with the upper spacer posts which are numbered 210 at the right and 212 at the left. All four posts are fixed to the bolt housing 214.

As in the case of the embodiment depicted in FIGS. 1 through 10, the bolt housing in this case is provided with a through bore whose axis is parallel with the rear face of the housing, the face that is shown in elevation in FIGS. 11 and 13, and is parallel also to the upper and lower edges of the housing 214. The primary bolt is shown in place in each of FIGS. 11, 12 and 13. In FIGS. 11 and 12, the primary bolt, which is numbered 216, is in the extended, or locked, position. In FIG. 13, the bolt is in retracted, or unlocked, position.

Unlike the primary bolt of the embodiment shown in FIGS. 1 through 10, this primary bolt has reduced diameter at its forward end. The reduction appears in a tapered section that is numbered 218 for identification. Moreover, a section 220 in the midregion along the length of the bolt is notched, or slotted, halfway through the bolt structure. Inspection of FIGS. 11, 12 and 13 will show that the notch has end walls that are parallel to one another and perpendicular to the central axis of the bolt. The bottom of the notch is a flat surface that contains the axis of the bolt, or nearly so. The bore through the housing has smaller diameter at the end at which the bolt is extended. The transistion from the larger to smaller diameter occurs at the point where the transition in bolt diameters occurs when the bolt is fully extended to the locking state.

Much of the primary bolt and the actuating and locking mechanism for the bolt is visible in FIGS. 11, 12 and 13 because the central area of the side of the bolt housing that lies against the door is milled out to make room for those operating elements. The operating elements are shown in assembled relation without the primary bolt and without the housing and without the mounting plate, mounting screws and spacers.

Turning to FIG. 15, the lock latch 208 is fixed to the end of a rotatable rod 226 which was formed with a notch 228 near the end of the rod 226 away from the latch handle 208. The notch has ends that are parallel with one another and are perpendicular to the central axis of the rod 226. The bottom of the notch is numbered 230. It is a flat surface that lies in the plane containing the axis of rod 226, or nearly so.

In FIG. 15 a short secondary bolt 232 has its lower end in the notch of the rod 226. The secondary bolt 232 also is formed with a notch in the midregion of its length. It, too, has end surfaces that are parallel to one another and perpendicular to the axis of bolt 232 in which the notch is formed. The bottom of the notch is a flat surface that contains the axis of the bolt 232. That bottom surface has been given the reference number 234. A bias spring 236 has one end trapped in the recess formed in the upper end of the secondary bolt 232, and the other end of that spring bears upon the primary bolt 216 at the end of a recess in the primary bolt that is formed by boring transversely through the primary bolt on an axis parallel to the plane that contains the bottom wall of the large notch 220 that is formed in the bolt 216. That bore is visible in FIG. 12 where it is numbered 240, and it is formed in that section of the bolt that lies between the notch of the bolt and the tapered shoulder 218. In FIG. 12, the larger diameter end of the primary bolt 216 is bored to receive a barrel lock 242. The lock is press fitted into a recess board into the left end of the bolt as used in FIG. 12. The cylindrical extension 244 which can be seen extending to the right of the barrel lock 242 in FIG. 12 is rotatable when the key of the lock is turned, and at its outer end it is notched halfway through the rod as best shown in FIG. 15 where the notch is identified by the reference number 246.

The apparatus in FIG. 15 is shown in the locked condition, the same condition that is depicted in FIGS. 11 and 12. The barrel lock extension 244 and the notch 246 are rotated in a direction to permit spring 236 to force the secondary bolt 232 down so that its end resides in the notch of the latch shaft 226. The lower end of the secondary bolt 232 is visible in FIG. 11. It will be apparent in FIG. 11 that that secondary bolt extends downwardly out of the primary bolt 216. It resides in a slot 250 which is formed in the bolt housing 214 so that it intersects the latch shaft 226 at a point which permits the secondary bolt 232 to enter into the notch of the latch shaft. A comparison of FIGS. 11 and 13 at that portion of the structure above the shaft 226 makes that clear.

As in the case of embodiments of FIGS. 1 through 10, there are four locks involved. One is the primary lock formed by the cooperation between the forward extendable part of the bolt 216, and the keeper that is formed in the door jamb. A second lock is one that controls whether or not the bolt 216 can be extended and retracted. It is formed by the secondary bolt 232 and the keeper opening in the housing through which the secondary bolt moves as it enters notch 230 of latch rod 226. The third lock is formed by the notch 234 in secondary bolt 232 and the end 244 of the fourth lock, barrel lock 242. In FIG. 15, if the barrel lock 242 is operated in a direction to unlock the inner lock, the extension 244 and the notch 246 will be rotated. Rotation counterclockwise in FIG. 15 will result in the rotatable shaft 244 lifting the secondary bolt 232 against the bias of spring 236 so that the lower end of the bolt 232 will be lifted out of the slot 250 of FIG. 13 back into the primary bolt 216. That having been done, it is possible to move the primary bolt to extend it out of the housing 214 or to retract it back into the housing.

It is also possible to unlock the secondary lock using the latch lever 208 and shaft 226 from the inside of the door notwithstanding that the barrel lock 242 is not unlocked so that the notch 246 remains oriented the way it is shown to be in FIG. 15. If the latch handle 208 is rotated to rotate shaft 226 through ninety degrees, the lower end of the short shaft 232 will be lifted out of the notch in the shaft 226. That is possible because the thickness of the shaft 244 of the barrel lock and the notch 246 is less than the length of the notch in the small shaft. The shaft 226 having been turned through ninety degrees, the small shaft will have been driven back up into the bolt 216, and again the bolt can be moved to extend and to retract its forward portion.

In this embodiment there is a lever system or set by which to move the primary bolt 216. That lever system includes a pivot pin 260 which is fixed to the bolt 216 at a point in the notch 220 of the bolt. A first lever 262 has pivotal connection at one end to the pin 260. At its other end, arm 262 has pivotal connection at a pin 264 to a second arm 266 which is fixed to a rotatable shaft 268. That shaft is mounted for rotation in a recess in the bolt housing that is not shown in the several views of the drawing. The end 270 of the handle shaft 268 is the portion that fits within that recess. The operating handle 205 is fixed to the end of shaft 268 at the outside of the mounting plate 202 as best shown in FIG. 14. When the handle is rotated clockwise to an angle of approximately ninety degrees, the arm 266 is driven from the position it is shown to have in FIG. 11 to the position that it is shown to have in FIG. 13. As the end of the arm 266, which is pinned to the arm 262, is rotated it draws the arm 262 and the bolt 216 with it. A conformation 272, formed when milling out the housing, serves to limit the degree of rotation of the lever system and, therefor, the degree of retraction of the bolt 216.

Both of these preferred forms employ a barrel lock. Except that the keys are different, and the locking pins are different, the two barrel locks are alike. It is the barrel lock 242 which is depicted in FIG. 16. The representation is somewhat schematic. What is depicted is a barrel lock that is conventional except in two respects. The upper spring biased pins are formed so that the upper portions of them have a greater dimension than do the lower portions. The preferred configuration is shown in FIG. 17, although this is not the only configuration that is possible within the invention. Here, the upper and lower portions of the spring bias pin 300 are cylindrical, and the upper portion 302 has greater diameter than the lower portion 304. The opening in the outer barrel 306 of the barrel switch in which those spring bias pins are accommodated inversely to the pin shape. Because of that, the pins cannot fall through into the bore in which the inner barrel 308 is disposed when that inner barrel is removed. The other feature is that a slot is formed in the outer wall of the outer barrel 306 which accommodates a key strip 310 that serves to close the openings in which the spring biased pins are disposed, and which serves also to bear against the several springs by which the spring bias pins are forced downwardly in the assembled condition of the unit. The construction is shown more clearly in the large fragment depicted in FIG. 18.

The advantage is that the user and the locksmith may dissemble the lock and alter the pin combination without the need for special tools.

Although I have shown and described certain specific embodiments of my invention, I am fully aware that many modifications thereof are possible. My invention, therefore, is not to be restricted except insofar as is necessitated by the prior art.

I claim:

1. A sliding bolt lock comprising:

a housing formed with a bolt passage;

a primary bolt disposed for reciprocation from one position to another position in said passage along said passage;

a keeper formed in said housing:

a secondary bolt carried by said primary bolt and movable relative to said primary bolt into engagement with said keeper in at least one of said positions of said primary bolt; and a lock carried by said primary bolt and operable to permit such engagement in said one of said positions.

2. The lock defined in claim 1 which further comprises a frame and a secondary bolt operating means in the form of a member mounted on said frame and operable at a point removed from the line of reciprocation of said primary bolt for engaging and disengaging said secondary bolt from said keeper.

3. The lock defined in claim 2 which further comprises biasing means for biasing said secondary bolt into engagement with said keeper and in which said secondary bolt operating means is capable of selective opposition to said bias.

4. The lock defined in claim 1 in which said primary bolt is formed with a secondary bolt receiving passage formed transversely to the direction of reciprocation of said primary bolt relative to said housing; and in which said secondary bolt is mounted for reciprocation in said secondary bolt receiving passage.

5. The lock defined in claim 4 in which said lock is a barrel lock carried by said primary bolt and having a rotatable operating member rotatable about an axis lying parallel to the line of reciprocation of said primary bolt, said operating member of said lock being engageable with said secondary bolt.

6. The lock defined in claim 1 which further comprises a secondary bolt operating means extending laterally from said housing for selectively disengaging said secondary bolt from said keeper.

7. The lock defined in claim 6 in which said secondary bolt operating means comprises an extension of said secondary bolt.

8. The lock defined in claim 7 in which said housing is formed with an elongated opening through which said secondary bolt operating means extends, the opening having size in the direction of its elongation to permit passage of said secondary bolt operating means along the length of said opening only when said lock permits disengagement of said secondary bolt from said keeper.

9. The lock defined in claim 8 in which said keeper is formed by housing conformations defined by said opening at a point along its length.

10. The lock defined in claim 9 in which the housing defines two keepers in which said secondary bolt is engageable at spaced points along the line of its travel as an incident to movement of said primary bolt along said passage.

11. The lock defined in claim 1 in which said housing is arranged for mounting on a mounting surface such that said passage lies entirely on one side of said surface; and said lock being mounted entirely within said primary bolt such that when the secondary bolt is disengaged from the keeper the primary bolt is moveable by moving the lock.

12. The lock defined in claim 11 in which said housing is formed with a flat surface which lies in a plane parallel to the line of movement of the primary bolt along said passage;

said housing having a curved outer surface lying parallel to said line of movement and extending from said flat surface at one of the edges of said flat surface to the opposite edge of said flat surface, whereby, when said flat surface of the housing is mounted on said mounting surface, any force exerted on said housing in a direction transverse to said line of movement and parallel to said mounting surface must be applied to said curved outer surface.

13. The lock defined in claim 6 which further comprises a lever set having pivotal connection and one end of the lever set to said housing and, at the other end of said set, to the primary bolt;

relative pivoting of the lever set operating to move the primary bolt along said passage.

14. The lock defined in claim 13 which further comprises means in the form of a member extending transversely to the direction of said passage for effecting relative pivoting of said lever set.

15. The lock defined in claim 14 in which said secondary bolt is reciprocally mounted on said primary bolt in a direction transverse to the direction of said passage and biased toward a position in which it extends beyond the confines of said primary bolt;

said lock and said secondary bolt operating means each being operable to retract said secondary bolt against its bias.

16. The lock defined in claim 15 in which said lock is operable between a locked and unlocked state, said secondary bolt operating means being ineffective to effect retraction of said secondary bolt when said lock is in locked state.

17. The lock defined in claim 15 in which said secondary bolt operating means is ineffective to effect retraction of said secondary bolt except when said primary bolt occupies a predefined position relative to said passage.

18. The lock defined in claim 2 in which the position of said secondary bolt operating means is indicative of the position of said primary bolt in said passage.

* * * * *